US005088716A

United States Patent [19]

Wirz

[11] Patent Number: 5,088,716

[45] Date of Patent: Feb. 18, 1992

[54] DEVICE FOR SCANNING THE LENGTH OF A SHEET IN A SHEET PROCESSING MACHINE, SUCH AS A SHEET-FED ROTARY PRINTING PRESS PARTICULARLY

[75] Inventor: Arno Wirz, Bammental, Fed. Rep. of Germany

[73] Assignee: Heidelberger Druckmaschinen AG, Heidelberg, Fed. Rep. of Germany

[21] Appl. No.: 488,633

[22] Filed: Mar. 5, 1990

[30] Foreign Application Priority Data

Mar. 4, 1989 [DE] Fed. Rep. of Germany ..... 3906960

[51] Int. Cl.[5] ..... B65H 5/08

[52] U.S. Cl. ..... 271/90; 271/108; 271/260; 271/261

[58] Field of Search ..... 271/5, 11.14, 91, 95, 271/96, 98, 104.105, 108, 258, 260, 261, 265; 294/64.1

[56] References Cited

U.S. PATENT DOCUMENTS

| | | | |
|---|---|---|---|
| 3,617,048 | 11/1971 | Albert | 271/108 |
| 3,627,311 | 12/1971 | Spinelli | 271/260 |
| 3,966,197 | 6/1976 | Riedl et al. | 271/260 |
| 4,090,702 | 5/1978 | Wirz | 271/260 |
| 4,127,265 | 11/1978 | Wirz et al. | 271/260 |
| 4,184,674 | 1/1980 | Wirz et al. | 271/260 |
| 4,236,710 | 12/1980 | Nakanura et al. | 271/260 X |
| 4,391,939 | 7/1983 | Estrom | 271/108 X |
| 4,869,989 | 9/1989 | Wirz et al. | 271/5 X |

FOREIGN PATENT DOCUMENTS

| | | | |
|---|---|---|---|
| 61248 | 5/1981 | Japan | 271/96 |
| 799067 | 5/1956 | United Kingdom | 271/260 |
| 1547776 | 6/1979 | United Kingdom | 271/98 |

*Primary Examiner*—Robert P. Olszewski
*Assistant Examiner*—Boris Milef
*Attorney, Agent, or Firm*—Herbert L. Lerner; Laurence A. Greenberg

[57] ABSTRACT

Device for scanning lengths of sheets in a sheet-processing machine, wherein the sheets travel with a leading and a trailing edge, including suction-air measuring nozzles alignable with the trailing edges of the sheets and connected to a suction-air source via control elements connected in an electrical circuit of the machine drive, a feeder for aligning the sheets to be processed at stops for the leading edges of the sheets, lift-type suckers for lifting the sheets individually off a pile of sheets, and have structure defining a scanning hole in at least one of the suction-air measuring nozzles, the one nozzle being disposed in the feeder and being directed towards the trailing edge of an uppermost sheet disposed on a pile of sheets, a suction-air connecting line connecting the one nozzle to the suction-air source, and a differential pressure-measuring valve connected in the line and cooperatively associated with the control elements.

6 Claims, 3 Drawing Sheets

DEVICE FOR SCANNING THE LENGTH OF A SHEET IN A SHEET PROCESSING MACHINE, SUCH AS A SHEET-FED ROTARY PRINTING PRESS PARTICULARLY

The invention relates to a device for scanning the length of a sheet in a sheet-processing machine, particularly a sheet-fed rotary printing press, including suction-air measuring nozzles alignable with the trailing edge of the sheet and connected to a suction-air source via control elements connected in an electrical circuit of the machine drive, a feeder for aligning the sheets to be processed at stops for the leading edge of the sheet, and lift-type suckers for lifting sheets individually off a pile of sheets.

Such a device has become known heretofore from German Patent 26 21 250 on a sheet-transfer drum of a sheet-fed rotary printing press for recto-and-verso or first form and perfector printing. Grippers for gripping the leading edge of a sheet and, also, suction-type grippers are disposed in longitudinally extending channels in the sheet-transfer drum in a line along the wall of the channel, and are connected to a suction-air source, for gripping the trailing edge of an advance-running sheet, two of the suction-type grippers being offset opposite the sheet-conveying direction with respect to the line, the suction-type grippers having a pressure monitor in their connecting line, so that the suction nozzles serve simultaneously as scanning nozzles in order to detect sheets of insufficient length, sheets with folded-over corners or dog-ears at the trailing edge thereof and other format defects, and in order to be able to shut down following printing units. In rotary printing presses for recto-and-verso or first form and perfector printing, short sheets are thereby detected, and suitable commands are triggered for controlling the press; for example, the next printing unit is switched off. If the trailing edge of a turned sheet were not gripped within the usual tolerance area or region by the grippers of the turning drum, this sheet might, in the following printing operations, be pulled entirely or partially out of the grippers, with resultant register errors. If a sheet is not gripped at all by its trailing edge in the turning apparatus, considerable consequential damage results, with the impression cylinder becoming inked and with the short sheet possibly travelling into the inking unit.

The aforementioned heretofore known device of this general type is not suitable for the detection of short sheets which, for example, because of electrostatic charging or the like, are entrained by the storage drum located upstream of a turning drum in a rotary printing press for recto-and-verso, i.e., first form and perfector, printing, due to which likewise considerable consequential damage results. At high press speeds, the problem caused by short sheets is particularly critical, because the length of time between the detection of the defect in the sheet and the possible necessity for shutting down the press is very short and may no longer be sufficient to prevent a short or otherwise defective sheet from entering the printing unit or to prevent printing by the impression cylinders.

Electrically or pneumatically operated means for monitoring defective sheets, particularly on the sheet turning device of rotary printing presses for recto-and-verso first form and perfector printing have also become known heretofore.

It is accordingly an object of the invention to provide a device for scanning the length of sheets so that sheets which are too short to pass through the printing units or which are otherwise unsuitable for printing are detected even before they enter the first printing unit, so that the press can be shut down before such a sheet is fed to the first printing unit by the feeder. It is a further object of the invention to provide such a device which could be retrofitted on existing presses.

With the foregoing and other objects in view, there is provided, in accordance with the invention, a device for scanning lengths of sheets in a sheet-processing machine, wherein the sheets travel with a leading and a trailing edge, including suction-air measuring nozzles alignable with the trailing edges of the sheets and connected to a suction-air source via control elements connected in an electrical circuit of the machine drive, a feeder for aligning the sheets to be processed at stops for the leading edges of the sheets, and lift-type suckers for lifting the sheets individually off a pile of sheets, comprising means defining a scanning hole in at least one of the suction-air measuring nozzles, the one nozzle being disposed in the feeder and being directed towards the trailing edge of an uppermost sheet disposed on a pile of sheets, a suction-air connecting line connecting the one nozzle to the suction-air source, and a differential pressure-measuring valve connected in the line and cooperatively associated with the control elements.

Suction-air measuring nozzles, in the device according to the invention, scan the sheets to be printed while they are still on the pile, it being advantageous that such scanning is performed when the uppermost sheet is lifted off the pile in the feeder and, as it remains briefly with its leading edge in a stop position, before the conveying means of the feeder take over the sheet and convey it across the feed table against the front lays. Through the use of the features according to the invention, it is also possible for sheets of a short ream and an impermissible ream offset or transposition to be detected at an early stage, thus preventing the troubles associated therewith. In contrast with heretofore known devices for scanning the length of sheets, the device according to the invention operates directly above the pile of sheets in the feeder, so that the press can be shut down before the defective sheet enters the first printing unit, this construction thereby providing a high level of safety even in the case of high-speed presses.

In accordance with another feature of the invention, the feeder has a suction head, the suction-air measuring nozzles being disposed in the suction head and being formed as lift-type suckers, the lift-type suckers being directed substantially perpendicularly to a region adjacent the trailing edge of the uppermost sheet in the pile of sheets, and being connected to the suction-air source, at least one of the lift-type suckers having a position wherein it is offset with respect to the others of the lift-type suckers in a direction to the trailing edge of the uppermost sheet, and being adjustable in the sheet travel direction Thus, the features according to the invention find advantageous use in a feeder with a suction head which includes suction nozzles, particularly lift-type suckers, formed with suction openings directed more or less perpendicularly at or toward the trailing region at the trailing or rear edge of the uppermost sheet on the pile of sheets, and which are connected to a suction-air source. In a preferred embodiment, at least one existing lift-type sucker is retrofitted with a suction-air measuring nozzle of the type according to the invention, and is aligned with the trailing edge of the uppermost sheet in the pile of sheets with its scanning hole offset with respect to the suction holes of the existing lift-type suckers towards the trailing edge of the sheet, the possibility of an adjustment in the sheet-conveying direction being advantageous in order to align the scanning hole in accordance with the precise size of sheet and to a length of sheet within the yet permissible tolerance limits, respectively.

Sheet scanning makes use of the fact that the sheets, possibly preloosened by loosening blowers, are vertically raised individually from the pile by the suction nozzles of the suction head before the sheets begin to be conveyed horizontally in the feeder. A sheet which is detected as being defective, for example a short sheet, results in an immediate shutdown of the feeder by differential-pressure measuring valves, so that the defective sheet remains on the pile and can be removed. This prevents consequential damage due to such defective sheets in the printing units of the printing press. The differential-pressure measuring valve may be disposed in the suction-air line before or after the rotary valve for suction-air control.

In accordance with a further feature of the invention, the one suction-air measuring nozzle is swivellable about an axis extending vertically to the plane of the sheets, and the scanning hole is disposed eccentrically to the axis.

In accordance with an added feature of the invention, the scanning hole is formed in a slip-on cap, and the cap is pluggable onto the one lift-type sucker in the suction head.

In accordance with an additional feature of the invention, the one suction-air measuring nozzle and one of the others of the lift-type suckers of the suction head are formed on a common body, the body being carried by a suction-air union of the suction head so as to be adjustable about a vertical axis of the suction-air union.

In accordance with yet another feature of the invention, the means in the one suction-air measuring nozzle are formed with another scanning hole which is eccentrically disposed in the one suction-air measuring nozzle, the nozzle being formed as a lift-type sucker.

In accordance with yet a further feature of the invention, the suction-air measuring nozzle is provided on one lift-type sucker of a double sucker and is formed by the cap, the cap being of elastic material formed with the scanning hole and being pluggable onto the one lift-type sucker.

In accordance with a concomitant feature of the invention, the suction-air measuring nozzle is formed as a drop-type sucker.

The foregoing offer features for retrofitting existing lift-type suckers in suction heads of the feeder in sheet-fed rotary printing presses with a suction-measuring nozzle for scanning lengths of sheets in the feeder of sheet-fed rotary printing presses which are already in operation, for example, by replacing existing lift-type suckers with lift-type suckers having an additional scanning hole which is then aligned to the rear or trailing edge of the uppermost sheet on the pile of sheets.

A plurality of suction-measuring nozzles according to the invention are advantageously disposed in a straight line in order also to detect sheets which are askew or sheets with folded-over corners (dog-eared) while they are yet in the feeder.

Other features which are considered as characteristic for the invention are set forth in the appended claims.

Although the invention is illustrated and described herein as embodied in a device for scanning the length of a sheet in a sheet-processing machine, such as a sheet-fed rotary printing press particularly, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 2:
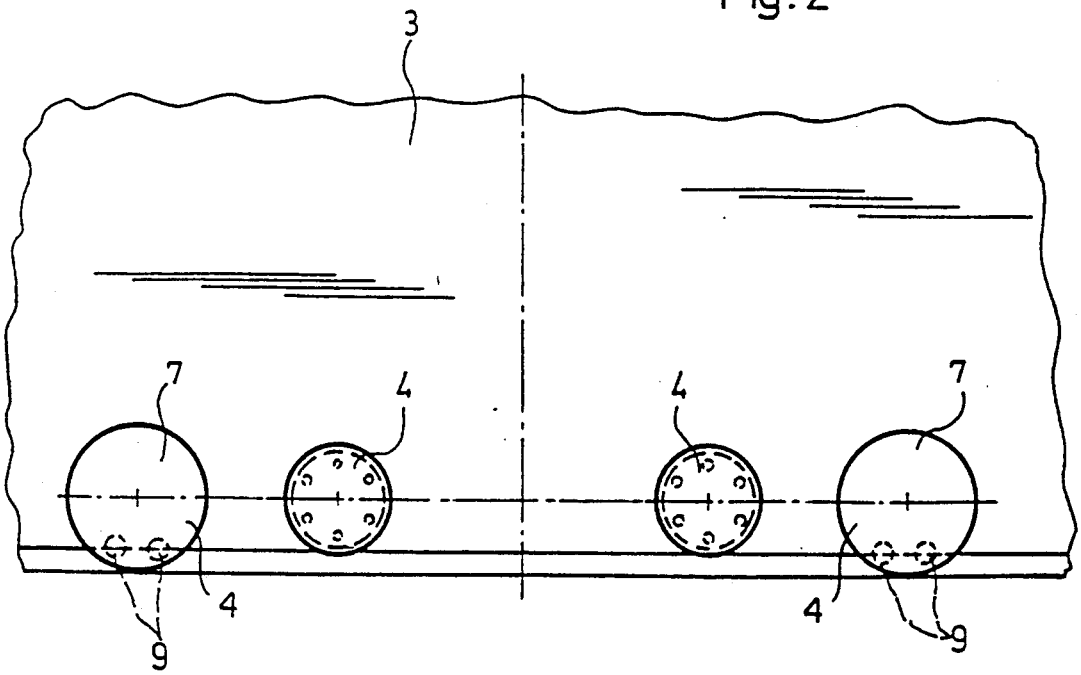
FIG. 2 is a top plan view of FIG. 1 rotated 90 degrees clockwise and showing diagrammatically an outline of a suction-nozzle arrangement of the suction head.
Figure 2A:
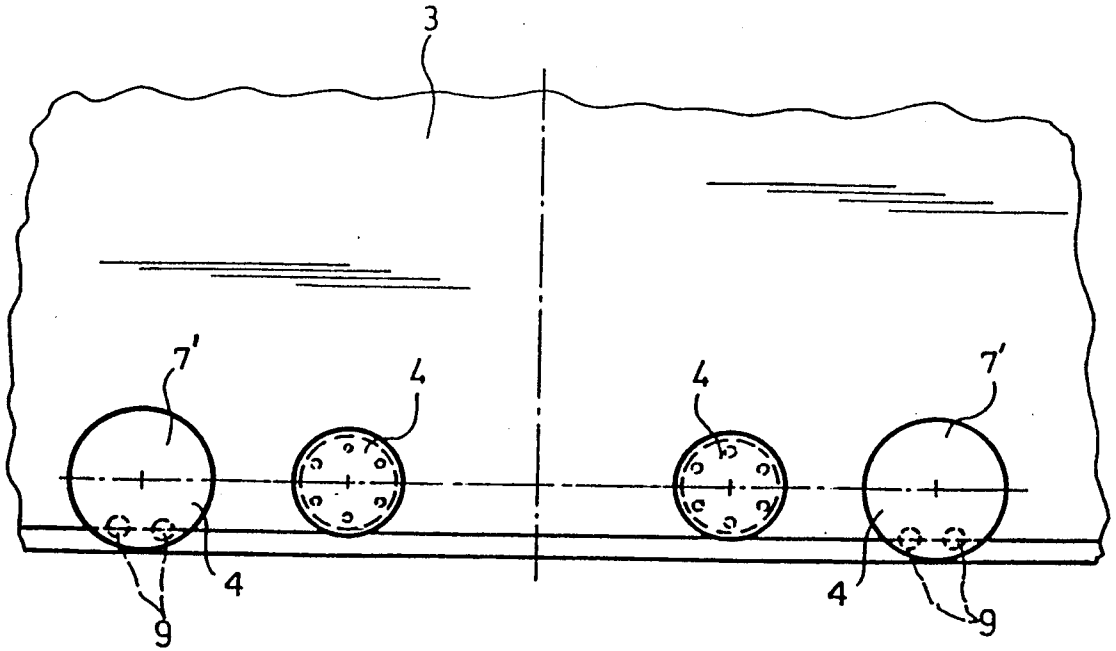

FIG. 2*a* is a variant suction nozzle arrangement of FIG. 2

Figure 3:
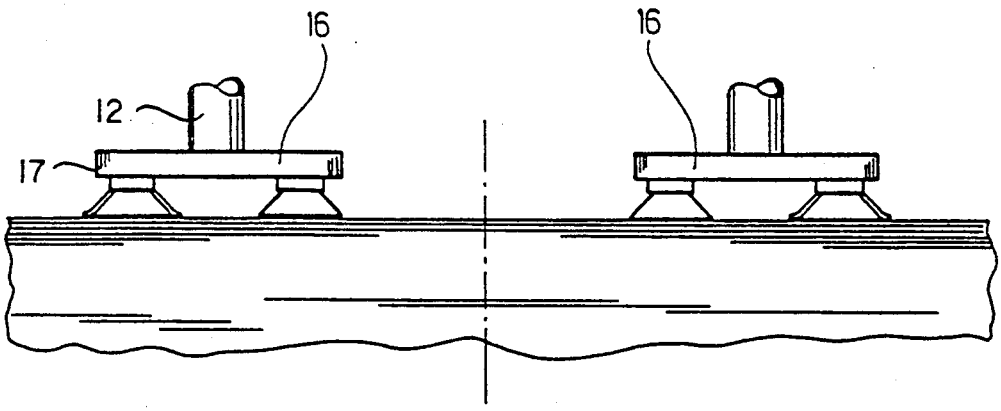
Figure 4:
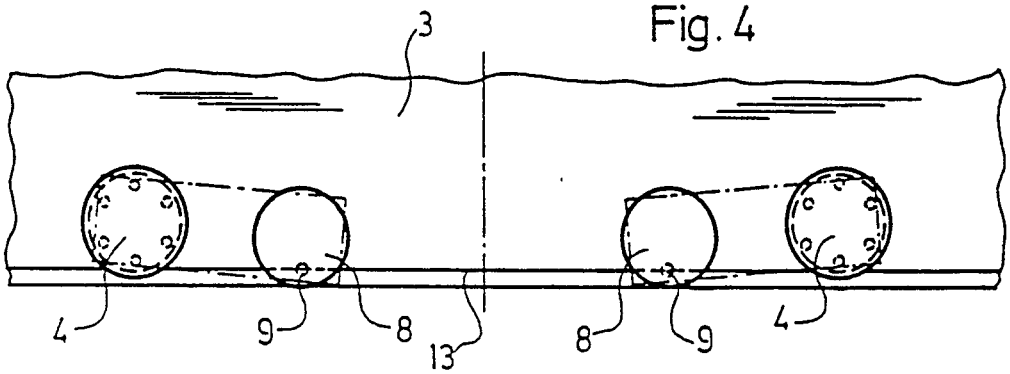
Figure 6:
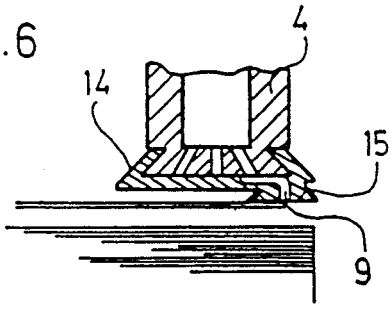
Figure 7:
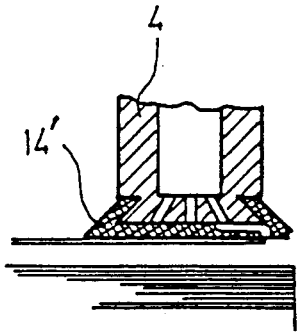
Figure 5:
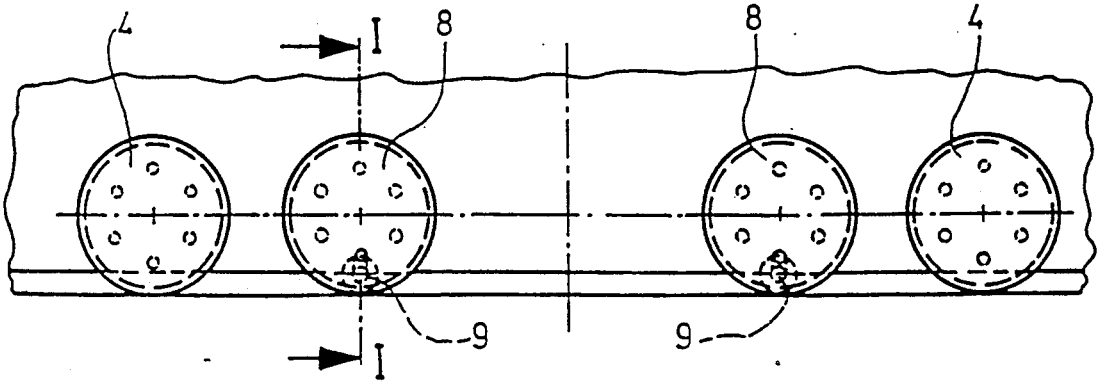

FIG. 3 is a diagrammatic rear elevational view of a suction head with double suckers above a pile of sheets;

FIG. 4 is a top plan view of FIG. 3 showing the double suckers in outline;

FIG. 5 is an enlarged view corresponding to that of FIG. 4 of another embodiment of the nozzle arrangement shown in outline;

FIG. 6 is a longitudinal sectional view of FIG. 5 taken along the line I—I wherein one of the suckers is formed with a scanning hole formed in a nipple-like projection; and FIG. 7 is a view like that of FIG. 6, wherein the sucker is formed with a scanning hole in a smooth surface thereof.

Before specifically referring to the figures of the drawing, it is noted that scanning the lengths of sheets which are too short for passage through the printing units or otherwise unsuitable for printing is performed beforehand prior to entry of the sheets into the first printing unit, so that printing can be stopped before such a sheet is fed to the first printing unit by the feeder. In a similar manner, short sheets can also be detected in other sheet-processing machines in order to trigger control operations which prevent the processing of such sheets. For scanning the length of a sheet, suction-air measuring nozzles are provided in the feeder and are directed to the trailing edge of the uppermost sheet of the pile of sheets in the feeder, from which the machine lifts off the sheets individually and supplies them for processing.

Figure 1:
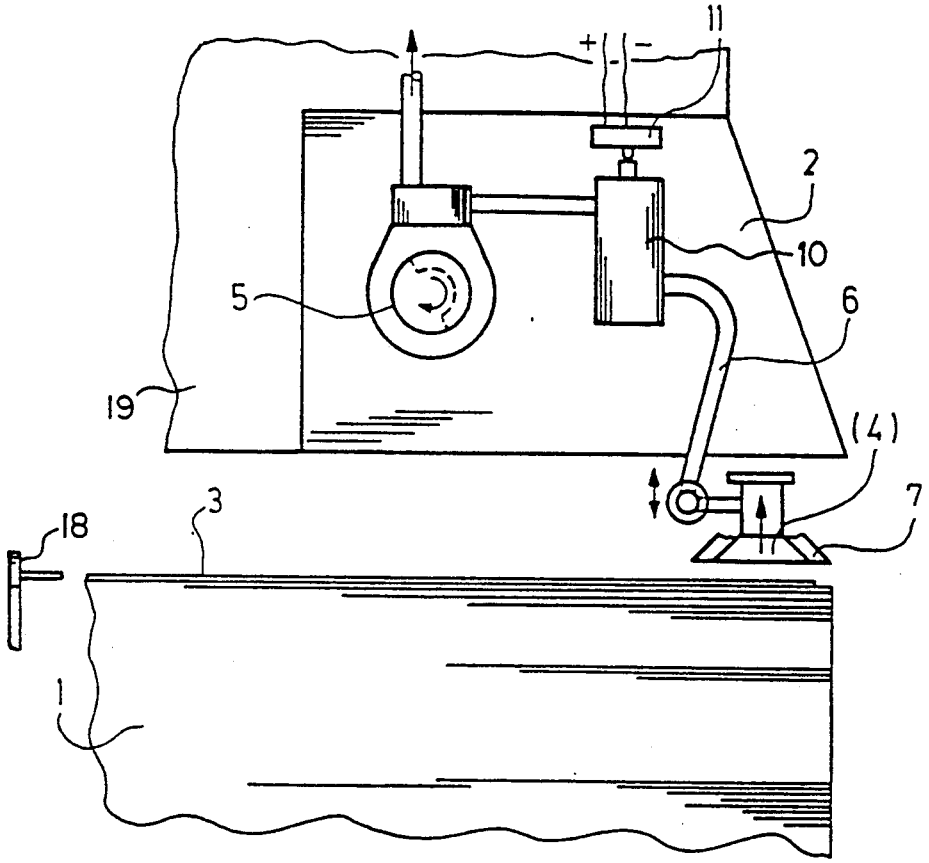
FIG. 1 is a diagrammatic side elevational view of a suction head of a sheet processing machine, namely a sheet-fed rotary printing press, above a pile of sheets.

Referring now to the drawing and, first, particularly to FIGS. 1 and 2 thereof, there is shown, at a given distance above a pile of sheets 1, a suction head 2 disposed in a feeder 19 of a sheet-fed rotary printing press and having lift-type suckers 4 or other types of suction-air nozzles for lifting off the uppermost sheet 3 from the sheet pile 1 and for conveying it into the feeder. Suction air furnished to the lift-type suckers 4 or the like from a non-illustrated conventional suction-air source is controlled by a rotary valve 5. In general, several of such lift-type suckers 4 are disposed in the rear or trailing region of the pile of sheets 1 and at the sides of the sheets. When suction air is applied to them, these lift-type suckers 4 lift off the previously loosened uppermost sheet 3 from the pile of sheets 1, so that carrying or support air can be blown under the sheet and the leading edge of the sheet impacts or strikes against stops 18 and remains briefly in this position before being conveyed into the feeder. For the purpose of detecting short sheets in the pile 1, at least one, but advantageously several suction-air measuring nozzles 7 are directed with their scanning holes 9 at and towards the trailing edge of the sheet in such a manner that the scanning holes are closed if the sheet which is lifted off is of normal length. The control of the supply of suction air to the suction-air measuring nozzles is accomplished likewise via the rotary valve 5. A differential-pressure measuring valve 10 with a microswitch 11 is disposed in the suction-air line 6 to the suction-air measuring nozzles 7 and is actuated by the differential pressure whenever a short sheet fails to close off the scanning hole 9 of the suction-air measuring nozzle 7. In its simplest construction, a suction-air measuring nozzle 7 may be in the form of an integral part of a lift-type sucker 4, so that one lift-type sucker 4 or several lift-type suckers 4 are replaced by one lift-type measuring sucker which, in addition to its suction openings, also has one or more scanning holes 9, which are directed at or toward the rear or trailing edge of the sheet 3 which has been lifted off the pile 1, as can be seen from the diagrammatic views of FIGS. 1 and 2.

FIGS. 2 and 2*a* show that either some of the conventional lift-type suckers 4 may be constructed with suction-air measuring nozzles 7 for lifting off the uppermost sheet, or additional suction-air measuring nozzles 7' may be provided, for example, in the form of conventional drop-type suckers, in addition to the customary lift-type suckers 4 for lifting off the uppermost sheet. The suction-air measuring nozzles 7 shown in FIG. 2 respectively have two scanning holes 9, which are directed at or toward the rear or trailing edge of the uppermost sheet on the pile of sheets. The scanning holes 9 are aligned so that a sheet 3 of normal length which is lifted off the pile closes off the scanning holes 9, whereas a short sheet will leave the scanning holes 9 either entirely or partially open when the short sheet has been lifted off the pile. This results in a vacuum being formed in the suction-air line 6, which connects the suction-air measuring nozzles 7 to the suction-air source via the rotary valve, this vacuum being registered by a differential-pressure measuring valve 10 placed in the line 6 either before or after the rotary valve 5. The vacuum thus registered by the differential-pressure measuring valve 10 is converted into a switching or control pulse for a microswitch 11, so that printing is stopped by the microswitch 11, or printing by the impression cylinders is prevented in another manner. Sheets of normal length completely close off the suction-air openings 9 of the suction-air measuring nozzles 7 so that no pressure difference occurs with respect to the lift-type nozzles 4.

FIGS. 3 and 4 illustrate the construction of a suction-air measuring nozzle on a conventional double sucker 16, the two lift-type nozzles of which are connected to a common T-shaped piece 17 for supplying suction air thereto, it being possible for the T-shaped piece 17 to be rotated about a vertical axis of a suction-air guide bolt or pin. Consequently, one lift-type sucker 4 and one suction-air measuring nozzle 8 are connected to a common supply line 12. The suction-air openings of the lift-type nozzle 4 are always covered by the sheet, while the scanning hole 9 of the suction-air measuring nozzle 8 is adjusted by turning the T-shaped piece 17 of the double sucker 16 so that, if the sheet is too short, the scanning hole 9 is no longer completely covered. In such a case, the trailing edge 13 of the sheet 3 which has been lifted off the pile 1 lies in the region of the scanning hole 9 or behind it in the conveying direction of the sheet 3.

FIGS. 5, 6 and 7 show advantageous examples of how a suction-air measuring nozzle can be made at relatively little constructional expense out of a conventional lift-type sucker 4. A cap 14, 14' preferably of an elastic plastic material, is slipped onto the lower end of a lift-type sucker 4, and has a base formed with only one eccentric scanning hole 9, which acts as the suction-air measuring nozzle. The other suction-air openings of the lift-type sucker are closed by the cap 14, 14'. The scanning hole 9 is directed at and towards the trailing edge of a sheet of minimum permissible length, as has been described hereinabove. The sectional view of FIG. 6 shows a cap 14 with a projection 15 at the scanning hole 9, while the embodiment in FIG. 7 exhibits a cap 14' with a flat base formed with the scanning hole.

The foregoing is a description corresponding in substance to German Application P 39 06 960.5, dated Mar. 4, 1989, the International priority of which is being claimed for the instant application, and which is hereby made part of this application. Any material discrepancies between the foregoing specification and the aforementioned corresponding German application are to be resolved in favor of the latter.

I claim:

1. Device for scanning lengths of sheets in a sheet-processing machine, wherein the sheets travel with a leading and trailing edge, including suction-air measuring nozzles alignable with the trailing edges of the sheets and connected to a suction-air source, and a feeder for aligning the sheets to be processed at stops for the leading edges of the sheets including lift-type suckers for lifting the sheets individually off a pile of sheets, comprising means defining a scanning hole in at least one of the suction-air measuring nozzles, said one nozzle being disposed on the feeder and being directed towards the trailing edge of an uppermost sheet disposed on a pile of sheets, a suction-air connecting line connecting said one nozzle to the suction-air source, and a differential pressure-measuring valve connected in said line, said one suction-air measuring nozzle being swivellable about an axis extending vertically to the plane of the sheets, and said scanning hole being disposed eccentrically to said axis.

2. Device according to claim 1, wherein means in said one suction-air measuring nozzle are formed with another scanning hole which is disposed in said one suction-air measuring nozzle eccentrically to a central axis thereof, said one nozzle being formed from a lift-type sucker.

3. Device according to claim 1, wherein said one suction-air measuring nozzle is formed as a drop-type sucker.

4. Device for scanning lengths of sheets in a sheet-processing machine, wherein the sheets travel with a leading and a trailing edge, including suction-air measuring nozzles alignable with the trailing edges of the sheets and connected to a suction-air source, and a feeder for aligning the sheets to be processed at stops for the leading edges of the sheets including lift-type suckers for lifting the sheets individually off a pile of sheets, comprising means defining a scanning hole in at least one of the suction-air measuring nozzles, said one nozzle being disposed on the feeder and being directed towards and trailing edge of an uppermost sheet disposed on a pile of sheets, a suction-air connecting line connecting said one nozzle to the suction-air source, and a differential pressure-measuring valve connected in said line, said feeder having a suction head, said suction-air measuring nozzles being disposed on said suction head and being formed from lift-type suckers, said lift-type suckers being directed substantially perpendicularly to a region adjacent the trailing edge of the uppermost sheet in the pile of sheets, and being connected to the suction-air source, at least one of said lift-type suckers having a position wherein it is offset with respect to the others of said lift-type suckers in a direction toward the trailing edge of the uppermost sheet, and being adjustable in the sheet travel direction, said one suction-air measuring nozzle and one of the others of said lift-type suckers of said suction head being formed on a common body, said body being carried by a suction-air union of said suction head so as to be adjustable about a vertical axis of said suction-air union.

5. Device according to claim 4, wherein said scanning hole is formed in a slip-on cap, and said cap is pluggable onto said one lift-type sucker in said suction head.

6. Device according to claim 5, wherein said one suction-air measuring nozzle includes one lift-type sucker of a double sucker and is formed by said cap, said cap being of elastic material formed with said scanning hole and being pluggable onto said one lift-type sucker.

* * * * *